United States Patent [19]

Vickers

[11] Patent Number: 4,942,948

[45] Date of Patent: Jul. 24, 1990

[54] COMBINATION BEACH BAG/BEACH RECLINER

[76] Inventor: Donna M. Vickers, 474 Hazelwood Ter., Rochester, N.Y. 14609

[21] Appl. No.: 308,549

[22] Filed: Feb. 10, 1989

[51] Int. Cl.[5] ..... A45C 9/00; B65D 33/00; B65D 81/36

[52] U.S. Cl. ..... 190/8; 190/1; 190/109; 190/117; 383/4; 5/119; 297/118; 297/380

[58] Field of Search ..... 190/1, 2, 8, 109, 111, 190/117; 383/4, 13; 5/417–419, 432; 297/129, 380, 118, 217

[56] References Cited

U.S. PATENT DOCUMENTS

| | | | |
|---|---|---|---|
| 1,140,997 | 5/1915 | Minehart | 190/8 |
| 2,044,717 | 6/1936 | McElmoyl | 190/8 |
| 2,135,419 | 11/1938 | Wesseler | 383/4 X |
| 2,490,367 | 12/1949 | Maddocks | 190/8 |
| 2,536,169 | 1/1951 | Gray | 383/4 X |
| 2,570,571 | 10/1951 | Leeman | 190/8 |
| 2,584,432 | 2/1952 | De Marco | 190/1 X |
| 2,816,599 | 12/1957 | Adams | 190/8 |
| 3,342,294 | 9/1967 | Beatty | 190/8 |
| 3,627,086 | 12/1971 | Caigan et al. | 190/8 |
| 4,273,221 | 6/1981 | Poag | 190/8 |

FOREIGN PATENT DOCUMENTS

| | | | |
|---|---|---|---|
| 2243938 | 3/1974 | Fed. Rep. of Germany | 190/8 |
| 2905830 | 9/1979 | Fed. Rep. of Germany | 297/380 |
| 835030 | 12/1938 | France | 190/109 |
| 2226945 | 11/1974 | France | 190/109 |

*Primary Examiner*—Sue A. Weaver
*Attorney, Agent, or Firm*—William F. Frank

[57] ABSTRACT

The present invention is an elongated, canvas-like article having sleeves at each end, the article providing basically the bottom and front and back sides of a bag to which are attachable, in various forms, side portions which complete the formation of the bag. The side portions contain pockets on the outer sides which are divided so as to provide separate receptacles for individual items. The inner side of each side portion is an elastic net-like covering which allows the insertion of items which do not require separate pockets. The invention also includes means for carrying the bag to the beach which means can also be utilized to provide a support for the reclining aspect of the invention in which the means for carrying the beach bag provide both a support against the sand as well as for the upper portion of the rectangular segment. The basic embodiment and the other two embodiments disclosed herein are substantially identical. The only difference is the manner in which the side portions of the bag are attachable to the main portion of the bag.

6 Claims, 10 Drawing Sheets

FIG. 9
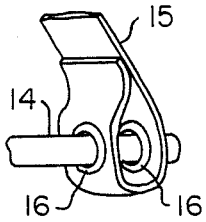
FIG. 13
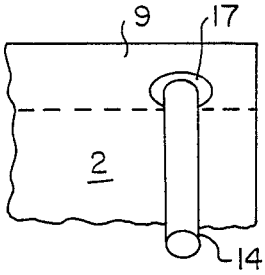
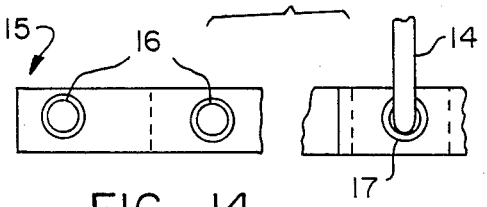
FIG. 14
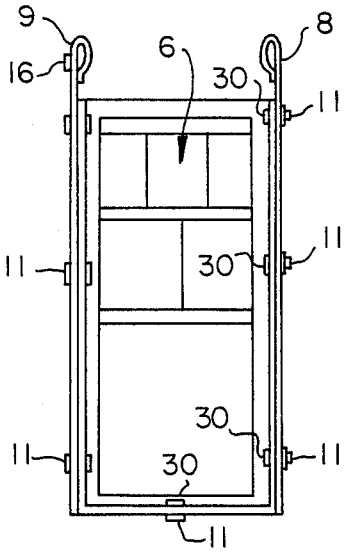
FIG. 30
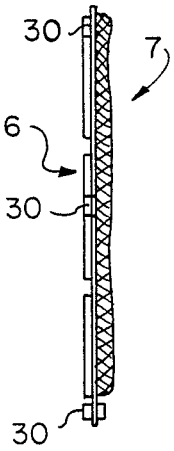
FIG. 28

FIG. 15
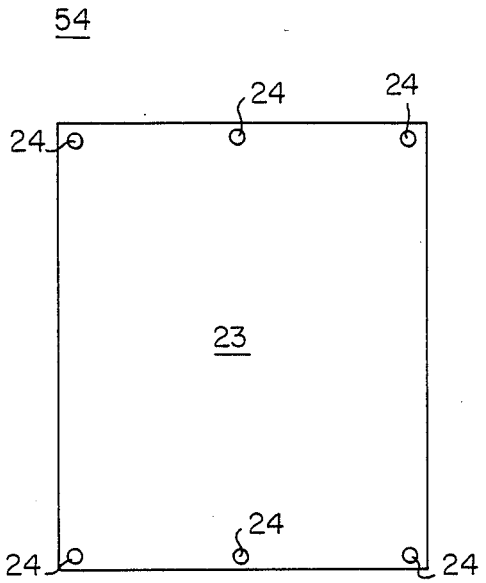
FIG. 16
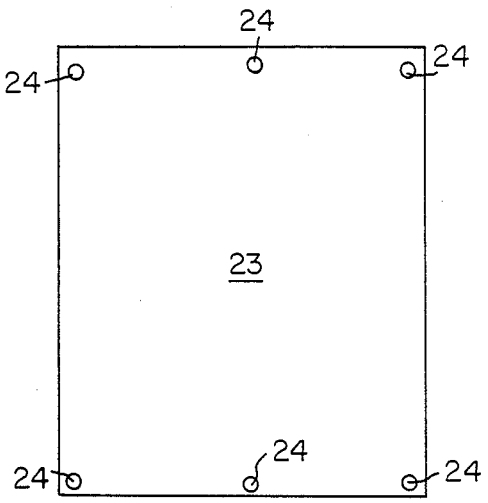
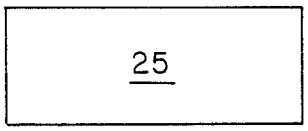
FIG. 17
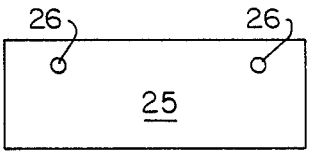
FIG. 18

COMBINATION BEACH BAG/BEACH RECLINER

FIELD OF THE INVENTION

The present invention is in the general field of luggage which can be converted into another use. More specifically, the present invention is a beach bag which can be converted into a beach recliner.

BACKGROUND OF THE INVENTION

For those who go to the beach, be it by lake or ocean, there is always a problem of having a means to carry all the paraphernalia. There are patents that disclose some form of a beach recliner or beach chair device but have no capacity to act as a carrying means for all the other items one must feel necessary to go to the beach. Contrawise, there are patents disclosing luggage devices for the beach but not convertible to a recliner.

SUMMARY OF THE INVENTION

The present invention is an elongated, canvas-like article having sleeves at each end, the article providing basically the bottom and front and back sides of a bag to which are attachable, in various forms, side portions which complete the formation of the bag. The side portions contain pockets on the outer sides which are divided so as to provide separate receptacles for individual items. The inner side of each side portion is an elastic net-like covering which allows the insertion of items which do not require separate pockets. The invention also includes means for carrying the bag to the beach which means can also be utilized to provide a support for the reclining aspect of the invention in which the means for carrying the beach bag provide both a support against the sand as well as for the upper portion of the rectangular segment. The basic embodiment and the other two embodiments disclosed herein are substantially identical. The only difference is the manner in which the side portions of the bag are attachable to the main portion of the bag.

BRIEF DESCRIPTION OF THE DRAWINGS

The present invention is seen in the accompanying illustrative drawings in which the items common to all three embodiments are commonly designated. The description of the drawings for the present invention are as follows:

FIG. 9 is a partial perspective view of the cooperation between the carrying/ground support strap and carrying/ground support rod in the beach bag mode of FIG. 1.

FIG. 13 is a partial perspective elevation view of the use of one end of the ground support rod of FIG. 8 for the mode seen in FIGS. 2 and 20.

FIG. 14 is a partial perspective elevation view of the use of the other end of the ground support rod for the mode seen in FIGS. 2 and 20.

FIG. 15 is one side of a beach blanket of the present invention.

FIG. 16 is the opposite side of the blanket seen in FIG. 15.

FIG. 17 is a plan view of the interior surface of the pillow of the present invention.

FIG. 18 is a plan view of the exterior surface of the pillow seen in FIG. 17.

FIG. 28 is an elevation view of the side panel as seen in FIGS. 26 and 27.

FIG. 30 is an end elevation view of the embodiment seen in FIG. 23.

DETAILED DESCRIPTION OF THE INVENTION

The basic details of the present invention can be seen with reference to FIGS. 1 through 14.

Figure 1:
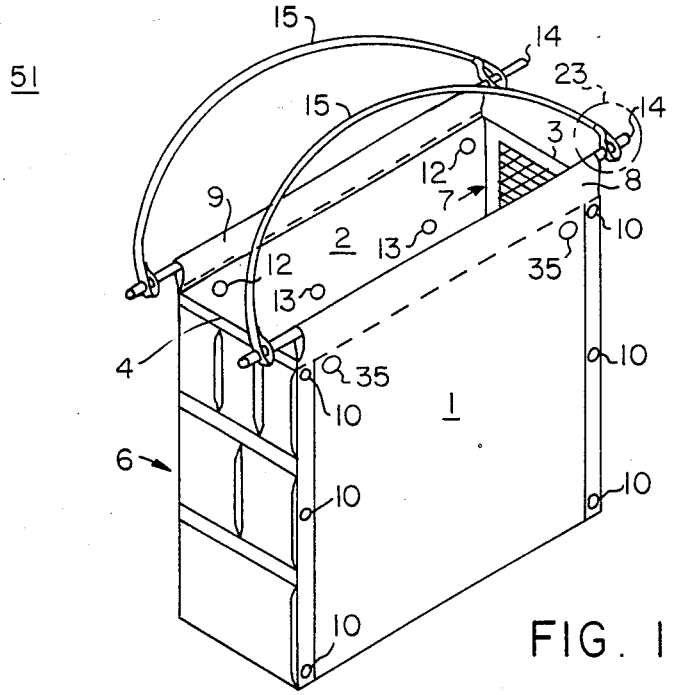
FIG. 1 is a perspective view of one embodiment of the present invention in the beach bag mode.
Figure 2:
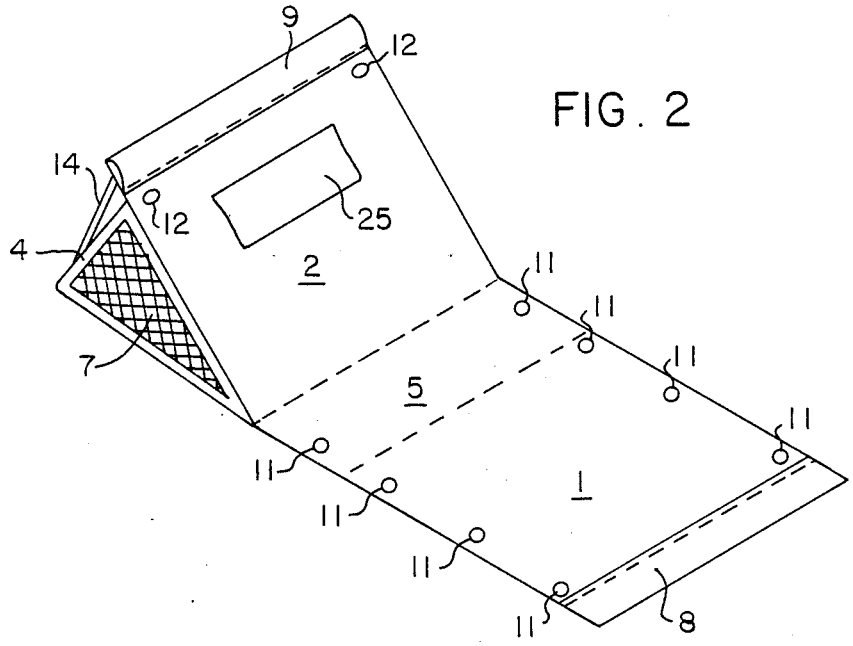
FIG. 2 is a perspective view of one embodiment of the present invention in the beach recliner mode.
Figure 3:
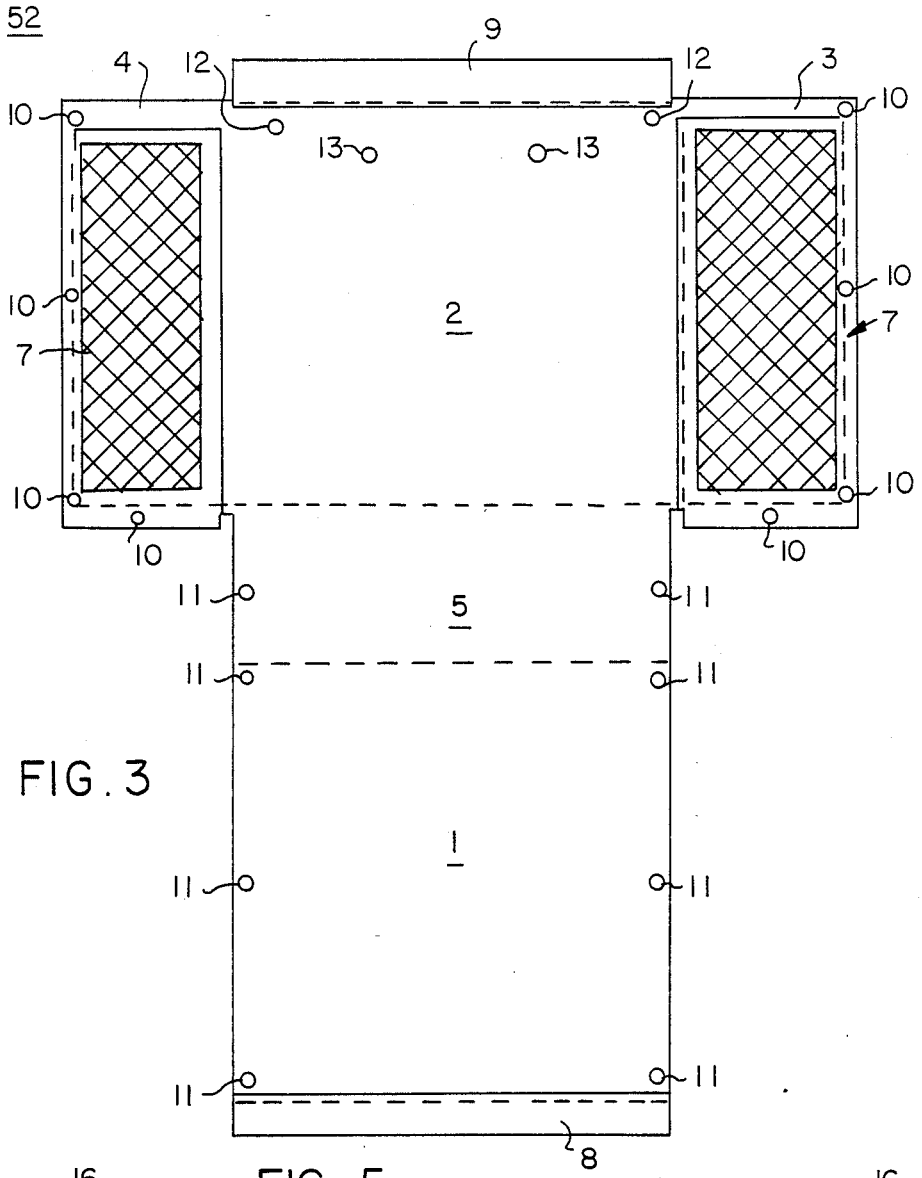
FIG. 3 is a plan view of the interior surface of the embodiment in FIG. 1 in a laid-out position.
Figure 5:
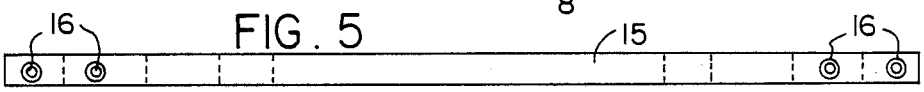
FIG. 5 is a plan view of the exterior surface of the carrying/ground support strap of the present invention.
Figure 6:
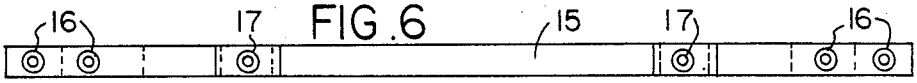
FIG. 6 is a plan view of the interior surface of the shape seen in FIG. 5.
Figure 7:
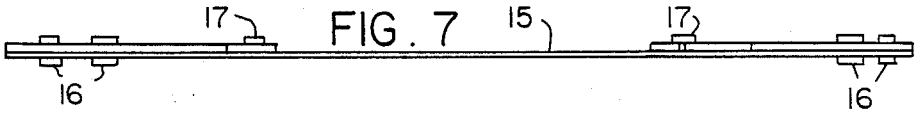
FIG. 7 is an elevation view of the strap seen in FIG. 5.

Referring now to FIG. 1, the present invention can be seen to consist of a bag-like element having a front side 1, a back side 2, a right end portion 3, and a left end portion 4. As seen in FIGS. 2 and 3, one can also observe that there is a bottom portion 5. Side portion 1 terminates in a sleeve B. Side portion 2 terminates in sleeve portion 9. End portion 3, as seen in FIG. 1, has on its inner surface an elastic net element 7. End portion 4 has on its outer surface a multi-pocketed surface 6. It is to be understood that end portion 3 has an outer surface 6 similar to end portion 4, just as end portion 4 has an inner surface 7 similar to that of end portion 3. End portions 3 and 4 carry a plurality of snaps 10 along their outer surfaces. These end portions 4 mate with snaps 11 seen along the exterior edges of both front portion 1, back portion 2 and bottom portion 5. As seen in FIGS. 1–14, sleeves 8 and 9 carry support rods 14 for both the bag mode of the invention as well as the recliner mode. For purposes of carrying the bag, there are provided straps 15, one for each of the rods 14. As seen particularly in FIGS. 5–7, straps 15 each carry a pair of grommets 16 on each end which pass completely through the strap 15. As seen in FIG. 9 particularly, the ends of rods 14 are placed through the two grommets 16 on each end of strap 15 in order to provide the securing of straps 15 to the bag embodiment. It is to be noted that in FIGS. 1–14, the end portions 3 and 4 have one edge which is integral with the side portion 2 of the embodiment shown therein.

Figure 10:
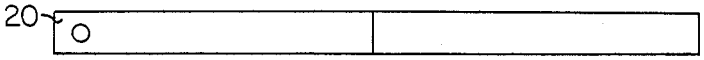
FIG. 10 is a plan view of the interior surface of the recliner support bar employed in FIGS. 2 and 20 of the present invention.
Figure 11:
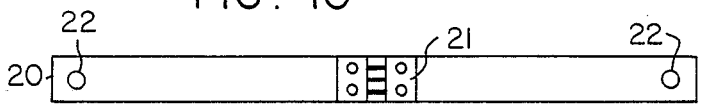
FIG. 11 is a plan view of the exterior surface of the recliner support bar seen in FIG. 10.
Figure 12:
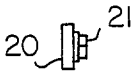
FIG. 12 is an end elevation view of the recliner support bar seen in FIG. 10.
Figure 4:
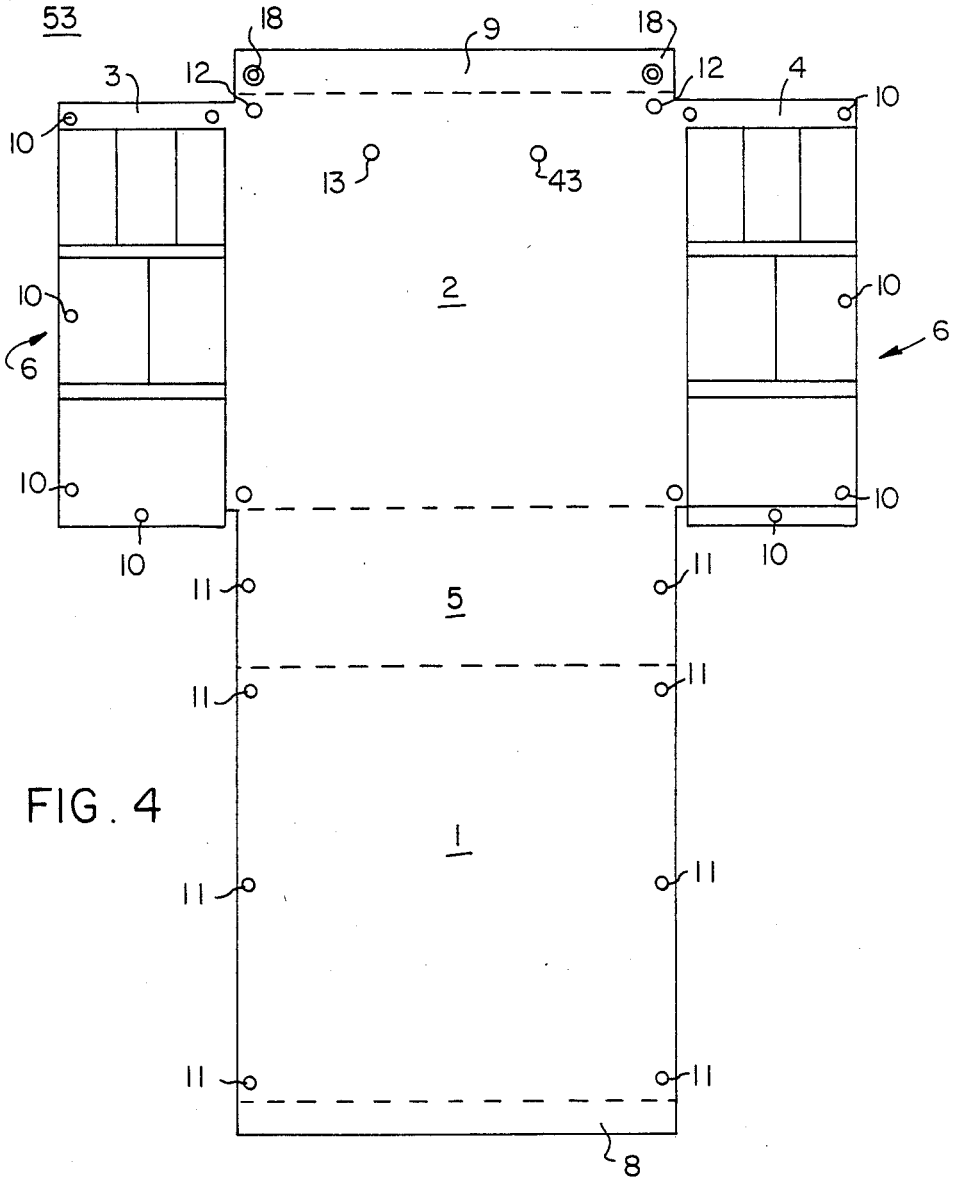
FIG. 4 is a plan view of the exterior surface of the embodiment in FIG. 1 in a laid-out position.
Figure 19:
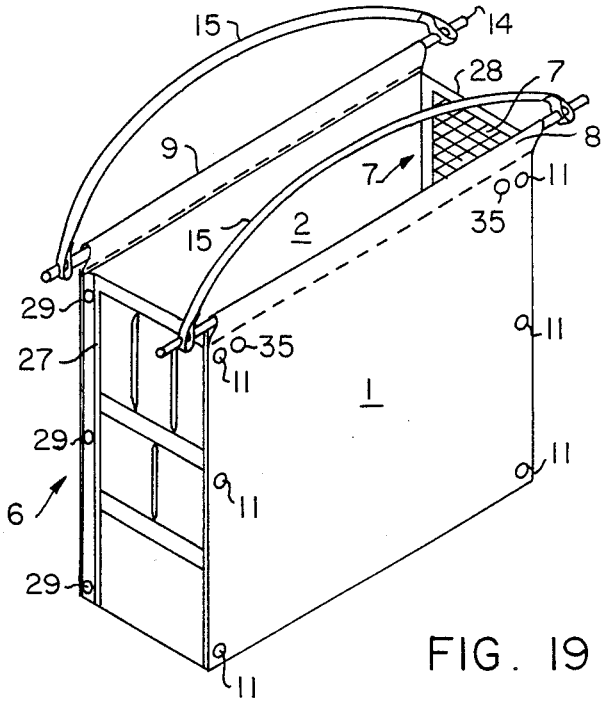
FIG. 19 is a perspective view of a second embodiment of the present invention in the beach bag mode.
Figure 20:
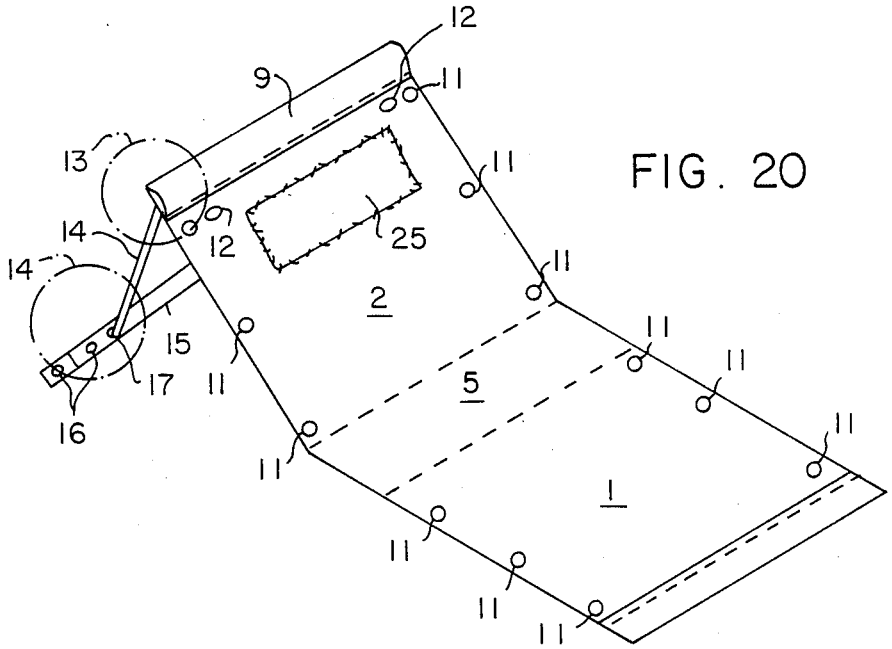
FIG. 20 is a perspective view of the second embodiment of the present invention in the beach recliner mode.
Figure 23:
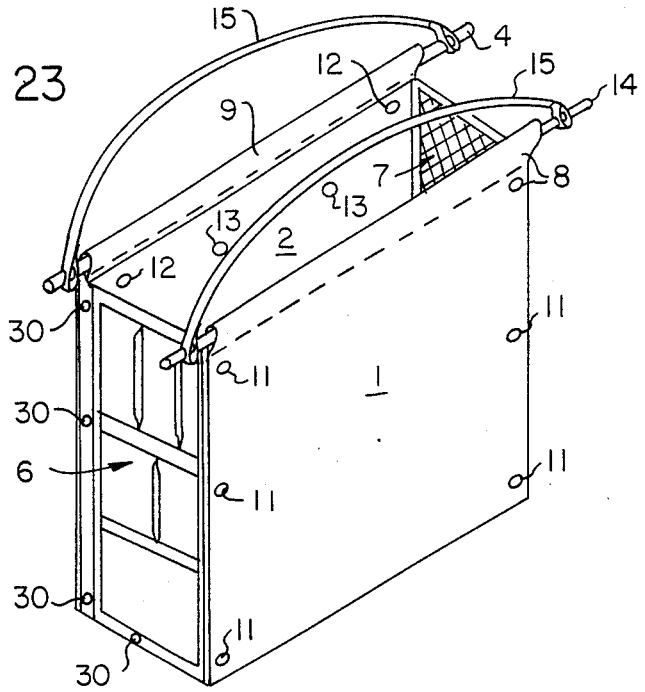
FIG. 23 is a perspective view of the third embodiment of the present invention in the beach bag mode.

Referring now to FIG. 2, the basic embodiment of the invention is shown in the beach recliner mode. It will be seen that the support rods 14 have now been utilized to raise the side portion 2 in the form of a back of a recliner for the user of the device. It is to be noted, particularly with reference to FIG. 20, and FIG. 14, that the side portion 2 is held in a reclined position by positioning support rod 14 in a grommet 17 of strap 15 in order to provide a support against the sand or other ground surface of the beach. The opposite end of the rod 14, as seen in FIG. 13, is positioned within grommet lB on the outer side of sleeve 9. Grommet 18 does not pass completely through the sleeve 9 nor does the grommet 17 in strap 15. It is to be further noted that in connection with the use of the support rods 14 in this recliner mode, there is shown in FIGS. 10, 11 and 12, a support plate 20 which is inserted into sleeve 9 to provide the rigidity of sleeve 9 in support of the weight of the body of the user. Support plate 20 is hinged, as shown at 21, because its length is such that it cannot be carried within the confines of the bag shown formed as shown in FIGS. 1, 19 and 23. The support plate 20 has on the surface containing the hinge two depressions 22 in which the end of each support rod 14 is inserted through grommet 18 after plate 20 is inserted into sleeve 9.

Figures 8, 21:
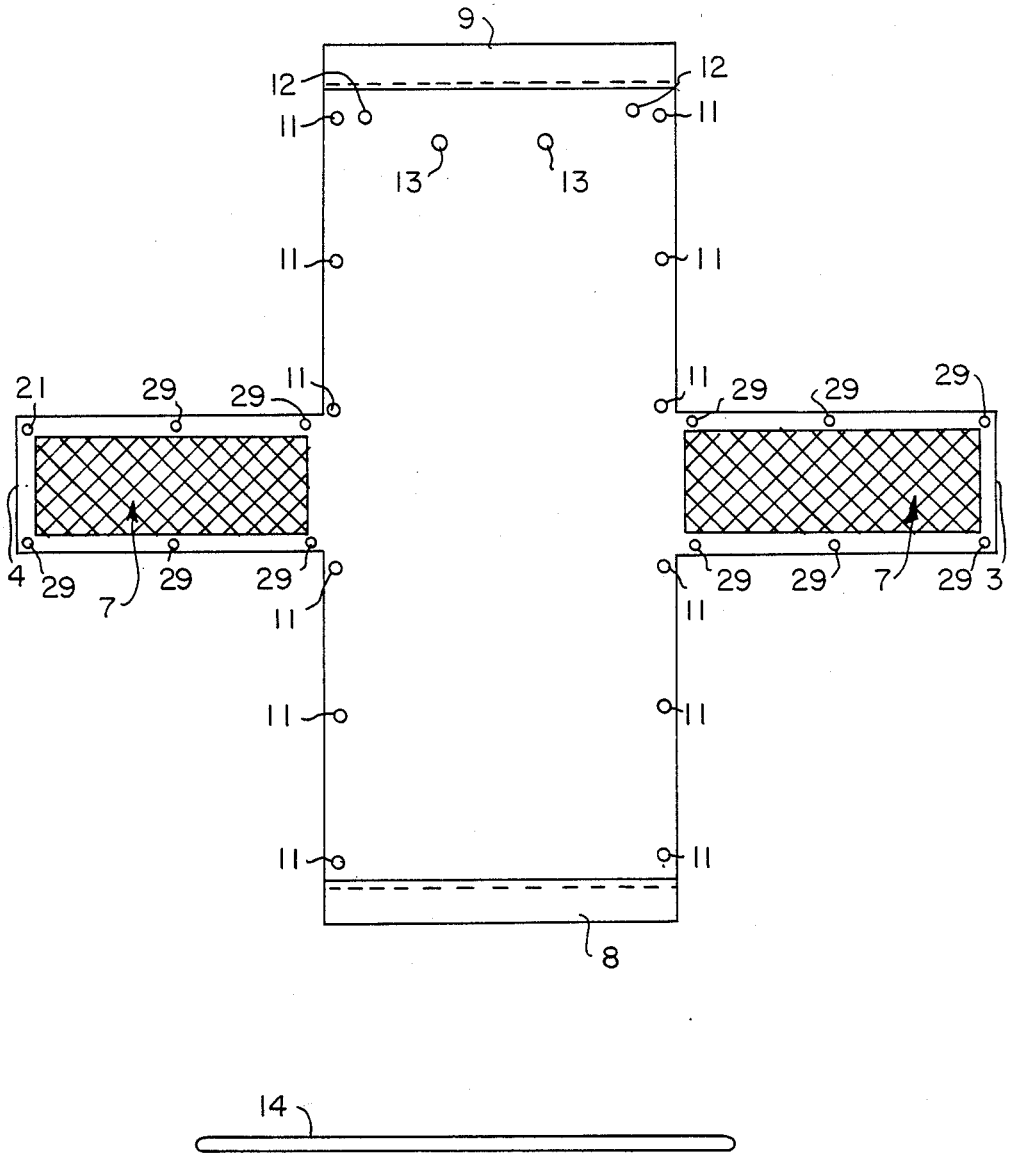
FIG. 8 is an elevation view of the carrying/ground support rod of the present invention.
FIG. 21 is a plan view of the interior surface of the second embodiment of the present invention in a laid-out position.
Figure 22:
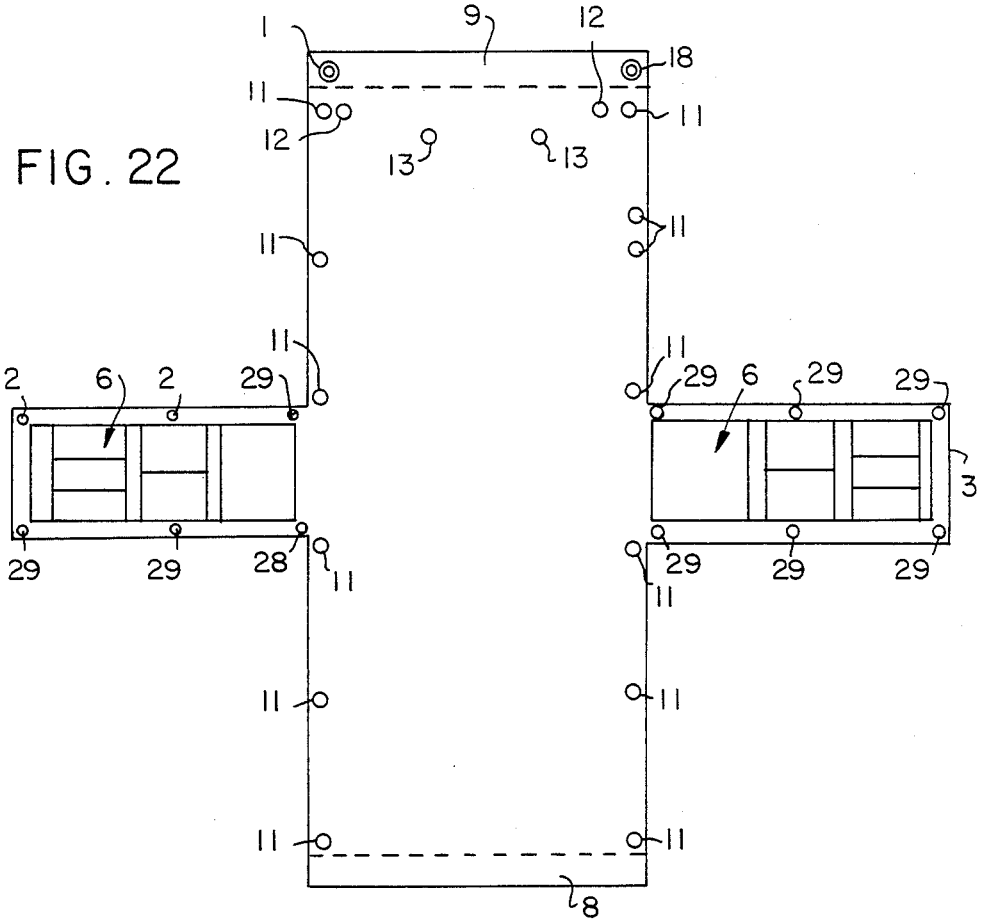
FIG. 22 is a plan view of the exterior surface of the embodiment of FIG. 20 in a laid-out position.
Figure 26:
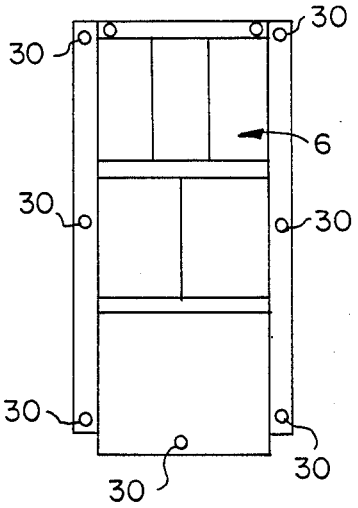
FIG. 26 is a plan view of the exterior surface of the side panel of the third embodiment.
Figure 27:
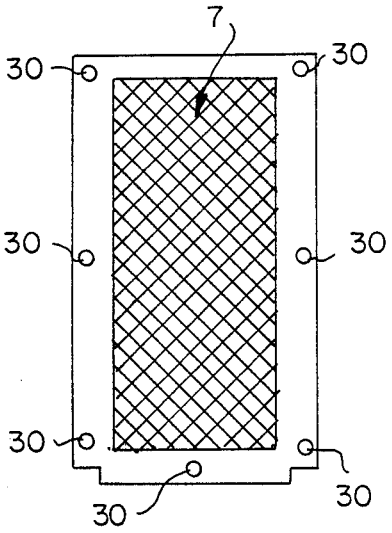
FIG. 27 is a plan view of the interior surface of the side panel seen in FIG. 26.
Figure 24:
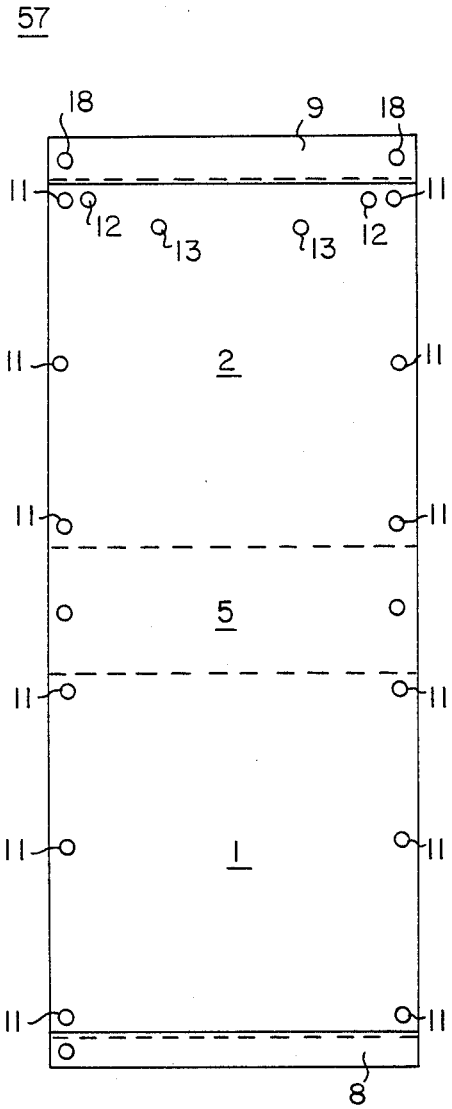
FIG. 24 is a plan view of the exterior surface of the third embodiment in a laid-out position.
Figure 25:
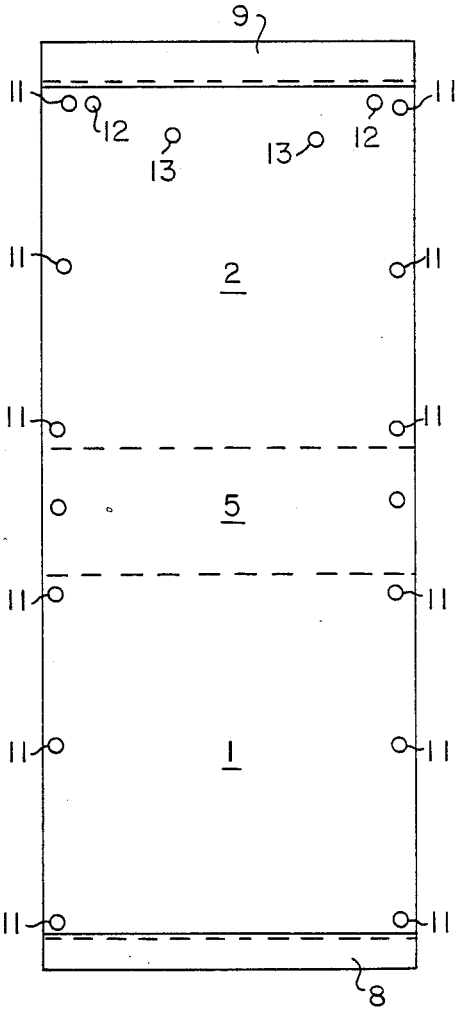
FIG. 25 is a plan view of the interior surface of the third embodiment in a laid-out position.

The end portions 3 and 4 as seen in FIGS. 21 and 22 are an integral part of the rectangular front, back and bottom portions, being integral with the bottom portion 5. In FIGS. 24 and 25, the side portions 3 and 4 are separate entities as seen in FIGS. 26 and 27. In each of these alternate embodiments the side portions have on the outer surfaces the pocketed side 6 and on the interior surfaces the netted side 7. As seen in FIGS. 21 and 22, side portions 3 and 4 carry a plurality of snaps 29 which engage snaps 11 on their respective front and back portions 1 and 2 as seen in FIG. 19 thus forming the bag. In this embodiment, the end portions 3 and 4 are inset within front and back portions of the bag as contrasted with the showing in FIG. 1 when they encompass the outside of side 1.

With reference to FIGS. 24 and 25, it can easily be seen that the invention in this embodiment comprises a strictly rectangular unit having a common front, back and bottom portions, 1, 2 and 5. The end portions 3 and 4 for employment with this embodiment can be seen in FIGS. 26 and 27. It is to be noted that these end portions have the common interior elastic netted surfaces 7 and the exterior pocketed surfaces 6. The end portions 3 and 4 for this embodiment are wider, FIG. 28, than those found in embodiment one but are identical to those found in embodiment two because of the need for providing adequate space for snaps 30 on each of the end portions which will engage with the corresponding snaps 11 on the front, back and bottom surfaces of the embodiment of the bag seen in FIGS. 24 and 25. The resulting employment of the use of these side portions can be most clearly seen in FIG. 28. It is apparent that the end portions 3 and 4 of the beach bag are inserted within the front, bottom and side portions as also clearly seen in FIG. 23. It is to be understood that, optionallly, these end portions could encompass the outside surfaces of side portions 1 and 2.

Elements pertinent to the invention but not essential to the bag/recliner modes of the invention can be seen in FIGS. 15–18 and 29. FIGS. 15 and 16 disclose a blanket element which is essentially a very heavy terry cloth type material with snaps 24. The purpose of snaps 24 is to permit the blanket 23 to be attached to the recliner in a recliner mode through snaps 12. The snaps 24 also are provided to permit the blanket 23 to be folded in half and then secured to snaps 35 on the exterior of side portions 1 and 2 in the event that one has so many articles to be carried to the beach that the blanket cannot be folded up and placed inside the bag. As seen in FIGS. 2, 17, 18 and 20, there is provided also a pillow 25 for use in the recliner mode, the pillow comprising again a terry cloth sleeve stuffed with a resilient material which is acceptable for laundering when necessary and which is attachable with snaps 26 to snaps 13 as seen on any of the figures relating to the interior surface of the present invention.

Figure 29:
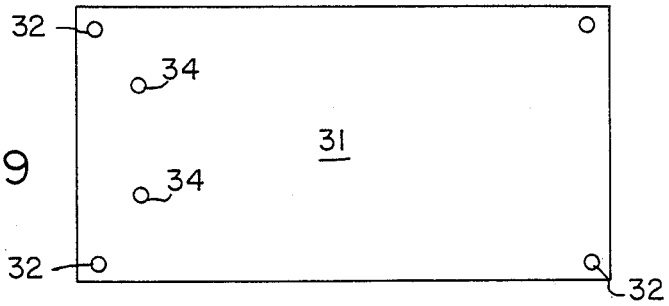
FIG. 29 is a plan view of a blanket for use with the present invention in the mode of the invention seen in FIGS. 2 and 20.

There is also provided, as seen in FIG. 29, a single blanket in contrast to the double blanket as seen in FIGS. 15 and 16, for use with the recliner. The single blanket 31 has on its interior surface snaps 32 which can also engage snaps 12 on the upper portion of side portion 2 of the present invention.

While the present invention has been disclosed in what are considered the normal embodiments of the present invention, modifications with respect to the size of pockets and addition of other snaps with accompanying accouterments are considered to be within the realm of the extension of the present invention and as recited in the accompanying claims.

What is claim is:

1. A beach bag/beach recliner comprising: a rectangular fabric element providing a front portion, back portion and bottom portion, the outer ends of each front and back portions including a sleeve formed thereon, each sleeve having a grommet at each end portion which grommet passes through only aid sleeve outer surface; two rectangular end portions, each having one side thereof as an integral portion of one of said portions of said fabric element, the remaining two sides of each end portion being attachable to the remaining portions of said rectangular element by a plurality of snaps on its respective unattached sides periphery to engage corresponding snaps on respective sides of said other portions of said fabric element to formulate the bag mode; a pair of carrying straps and a pair of support rods, said support rods each being insertable within one of said sleeves, each said carrying strap having first means on the respective ends thereof to encompass each end of said support rods in said sleeve to provide an interlocking engagement therewith for carrying said element in a bag mode formed by the snapping together of said front, back, bottom portions and said end portions; each strap having second means on said ends to engage one end of each support rod in said recliner mode; each aforesaid end portion having on each outer side thereof a plurality of pockets and one the inner sides thereof an elastic net element forming an expandible pocket; a hinged rectangular rigid member dimensioned to be insertable selectively in one of said sleeves in said front and back portions to provide upper lateral support to said portion which provides support for the back of the user in the recliner mode, said rigid member including means on its extremities for engaging the ends of the support rods, one end of each of said support rod passing through the said grommet in said sleeve and being engaged with said rigid member at its extremities, the other end of each support rod cooperatively engaged with said second means on one of said straps to provide ground support to each rod to form the recliner mode.

2. The beach bag/recliner according to claim 1 wherein each end of said straps has a portion doubled over and secured to an inner side of said strap by a first seam spaced from the outer end of said doubled over portion to accommodate said first means which comprises two spaced apart grommets passing through said doubled over portion thereby securing said doubled over portion to said strap, said grommet carrying portion being formed as a loop whereby said spaced grommets interlockingly engage and hold each respective end of each said support rod as a carrying support in said beach bag mode, said doubling over portion having a second seam interiorly spaced from said first seam to form a pocket therebetween, the outer side of each said strap pocket bearing said second means which comprises a third grommet therethrough to receive said other end of one of said support rods to support said front or back portion of said elements as a back rest for the user in said recliner mode.

3. The beach bag/recliner according to claim 1 wherein said support member comprises a rectangular element of a length equal to the width of said front or back portion and having a width and depth acceptable by said sleeve in said front or back member, the support member further having a hinge on one surface at its mid-line for folding the support member in half for carrying in said bag mode, said engagement means on said support member being defined by a recess in each end on the surface bearing said hinge which recess is positioned on said member to mate with said grommet in said sleeve to receive and hold said one end of each support rod in the recliner mode.

4. The combination set forth in claim 1 wherein the end portions are integrally formed as a part of the back portion of said element.

5. The combination as claimed in claim 1 wherein the end portions are integrally formed as a part of the bottom portion of said rectangular element.

6. A beach bag/beach recliner comprising: a rectangular fabric element providing a front portion, back portion and bottom portion, the outer ends of each front and back portions including a sleeve formed thereon, each sleeve having a grommet at each end portion which grommet passes through only said sleeve outer surface; two separate rectangular end portions, each having snaps along each longer side and one shorter side to be attachable to the front, back and bottom portions of said rectangular element by a plurality of corresponding snaps on the respective sides of said front, back and bottom portions of said fabric element to form a bag; a pair of carrying straps and a pair of support rods, said support rods each being insertable within one of said sleeves, each said carrying strap having first means on the respective ends thereof to encompass each end of said support rods in said sleeve to provide an interlocking engagement therewith for carrying said element in a bag mode formed by the snapping together of said front, back, bottom portions and said end portions; each strap having second means on said ends to engage one end of each support rod in said recliner mode; each aforesaid end portion having on each outer side thereof a plurality of pockets and on each inner side thereof an elastic net element forming an expandible pocket; a support member dimensioned to be insertable selectively in one of said sleeves in said front and back portions in said recliner mode to provide upper lateral support to said portion which provides contact support for the back of the user in the recliner mode, said support member including means on its extremities for engaging the ends of the support rods, one end of each of said support rod passing through said grommet in said sleeve and being engaged with said support member at its extremities within said sleeve, the other end of each support rod cooperatively engaged with said second means on one of said straps to provide ground support to each rod to form the recliner mode.

* * * * *